United States Patent [19]

Aureli

[11] 4,131,223

[45] Dec. 26, 1978

[54] APPARATUS FOR GAPPING A SLIDE FASTENER

[75] Inventor: William D. Aureli, Watertown, Conn.

[73] Assignee: Scovill Manufacturing Company, Waterbury, Conn.

[21] Appl. No.: 857,777

[22] Filed: Dec. 5, 1977

[51] Int. Cl.[2] ..... B26D 1/06; B26D 9/00; B26F 3/00

[52] U.S. Cl. ..... 225/94; 83/620; 83/921

[58] Field of Search ..... 225/94; 83/921, 620; 29/408, 770, 766

[56] References Cited

U.S. PATENT DOCUMENTS

| | | | |
|---|---|---|---|
| 2,987,809 | 6/1961 | Burbank | 29/408 |
| 3,005,581 | 10/1961 | Burbank | 225/94 |
| 3,540,090 | 11/1970 | Takamatsu | 29/408 X |
| 3,831,474 | 8/1974 | Perlman | 83/921 X |

*Primary Examiner*—Frank T. Yost
*Attorney, Agent, or Firm*—Dallett Hoopes

[57] ABSTRACT

Gapping apparatus includes offset knife sets adapted on closing to break the legs of the U-shaped fastener elements in the desired gap zone. Cutters are also provided to sever the end cords of the elements so that parts of the fastener elements in the gap area are completely liberated upon the opening of the apparatus. Indexing means are provided.

5 Claims, 9 Drawing Figures

APPARATUS FOR GAPPING A SLIDE FASTENER

BACKGROUND OF THE INVENTION

1. Field of the Invention

This invention relates to an apparatus for gapping a slide fastener chain as is useful in the manufacture of discrete slide fastener lengths from an endless chain. More specifically, the invention relates to gapping apparatus for use with slide fasteners such as disclosed in the Cuckson U.S. Pat. No. 3,414,948, issued Dec. 10, 1968, and other fasteners having U-shaped elements held in longitudinal relationship by end cords molded into the elements.

2. Description of the Prior Art

In the prior art, there are a number of patents disclosing apparatus for making gaps in slide fasteners as a step in the production of a finite length slide fastener from an endless slide fastener chain. Examples include the Burbank U.S. Pat. Nos. 2,877,844, issued Mar. 17, 1958, and 2,987,809, issued June 13, 1961; and Fasciano U.S. Pat. Nos. 3,128,543, issued Apr. 14, 1964 and 3,225,430, issued Dec. 28, 1965.

The prior art also discloses slide fasteners, each stringer of which comprises a plurality of longitudinally aligned U-shaped fastener elements longitudinally spaced by having spacing cords molded into the ends of the respective legs. The line of fasteners is then secured to the tape by receiving the edge of the tape into the opening of the U-shaped elements and by stitching the legs to the interposed tape.

SUMMARY OF THE INVENTION

In the present invention, an apparatus is provided comprising sets of knives which work against the legs of the U-shaped fastener element in the zone of the desired gap and break the legs of the elements without disturbing the stitching. The apparatus also includes means for severing the end cords at the ends of the desired gap so that the fastener element parts may be readily removed from the tapes in the area.

The invention also includes means to position the chain longitudinally on the apparatus so that the area in which the knives work will exactly coincide with the desired gap area.

BRIEF DESCRIPTION OF THE DRAWINGS

Other features and objects of the invention will be apparent from a study of the following specification and the appended drawings, all of which disclose a preferred but non-limiting embodiment of the invention. In the drawings.

DESCRIPTION OF THE PREFERRED EMBODIMENT

Figure 9:
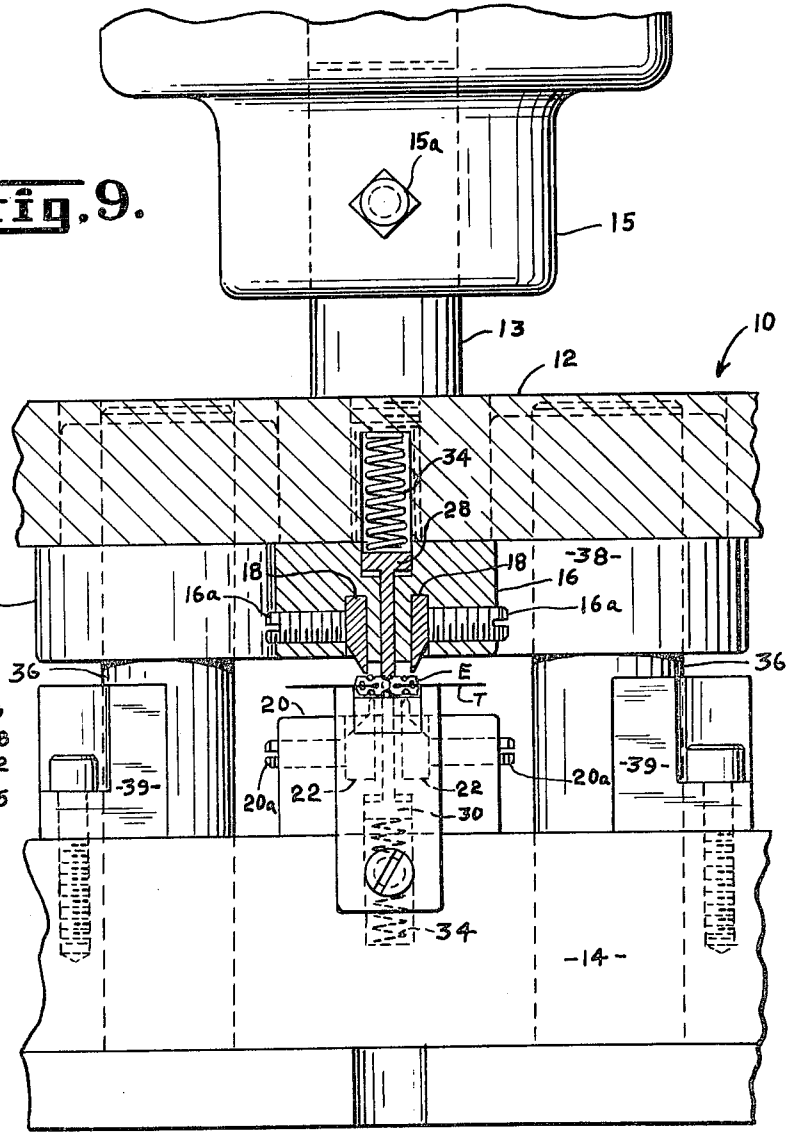
FIG. 9 is an end view of the lower half of FIG. 8 and a sectional view of the upper half taken on line 9—9 of FIG. 8.
Figure 8:
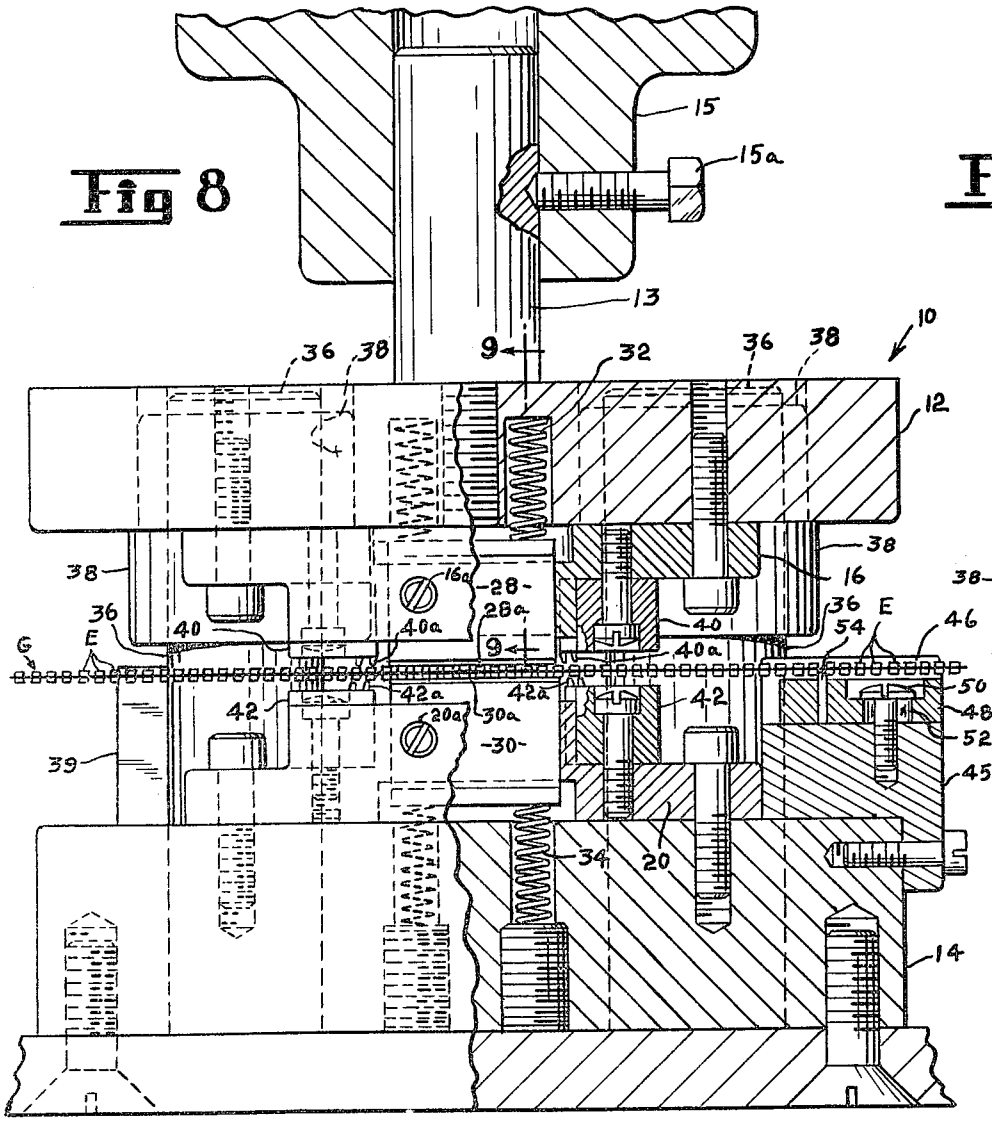
FIG. 8 is a side elevational view, partly in section, of an apparatus embodying the invention performing a gapping operation on a slide fastener chain.

Referring more specifically to FIG. 8, an apparatus embodying the invention is generally designated 10. It comprises the top plate 12 and lower bed plate 14. The upper plate 12 is secured to a vertical shaft 13 in turn held by a gripping chuck 15 as by a set screw **15*a* (FIGS. 8, 9**). The lower bed plate and the chuck comprise the working parts of a press, commercially available, such as a Perkins press.

To the top plate 12 is bolted, as shown in FIG. 8, a die holder 16 which is adapted to removably hold a pair of spaced parallel knives 18 by set screws **16*a***.

To the lower bed plate 14 is also bolted the lower die holder 20 which removably holds a second pair of lower parallel spaced knives 22 by set screws **20*a***.

Intermediate the knives, the die holders 16 and 20 are formed with slots (FIG. 1) 24 and 26 respectively, which receive the stems respectively of T-shaped elongate support guides 28 and 30. The adjacent ends of these guides include rounded portions **28*a* and 30*a*, respectively, adapted to engage, support and guide the interengaged zone of the slide fastener elements E of the chain in the area of the desired gap. As shown, springs 32 and 34**, disposed in the respective bed plates, urge the T-shaped guide elements toward each other.

To assure the proper relationship of the blades 18 and 22, the plates 12 and 14 are aligned by the use of stout guide pillers 36 (FIGS. 8,9) extending upwardly from the bottom of the lower bed plate 14 and fitting in sliding fashion into openings in the upper guide bushings 38. Preferably, such pillar-and-bushing alignment means are provided adjacent the four corners of the plates 12,14. Stops 39, bolted to the bed plate, are engaged by the lower portion of the top plate 12 to limit the downward movement of the top plate.

Figures 1, 2, 3, 4, 5, 6, 7:
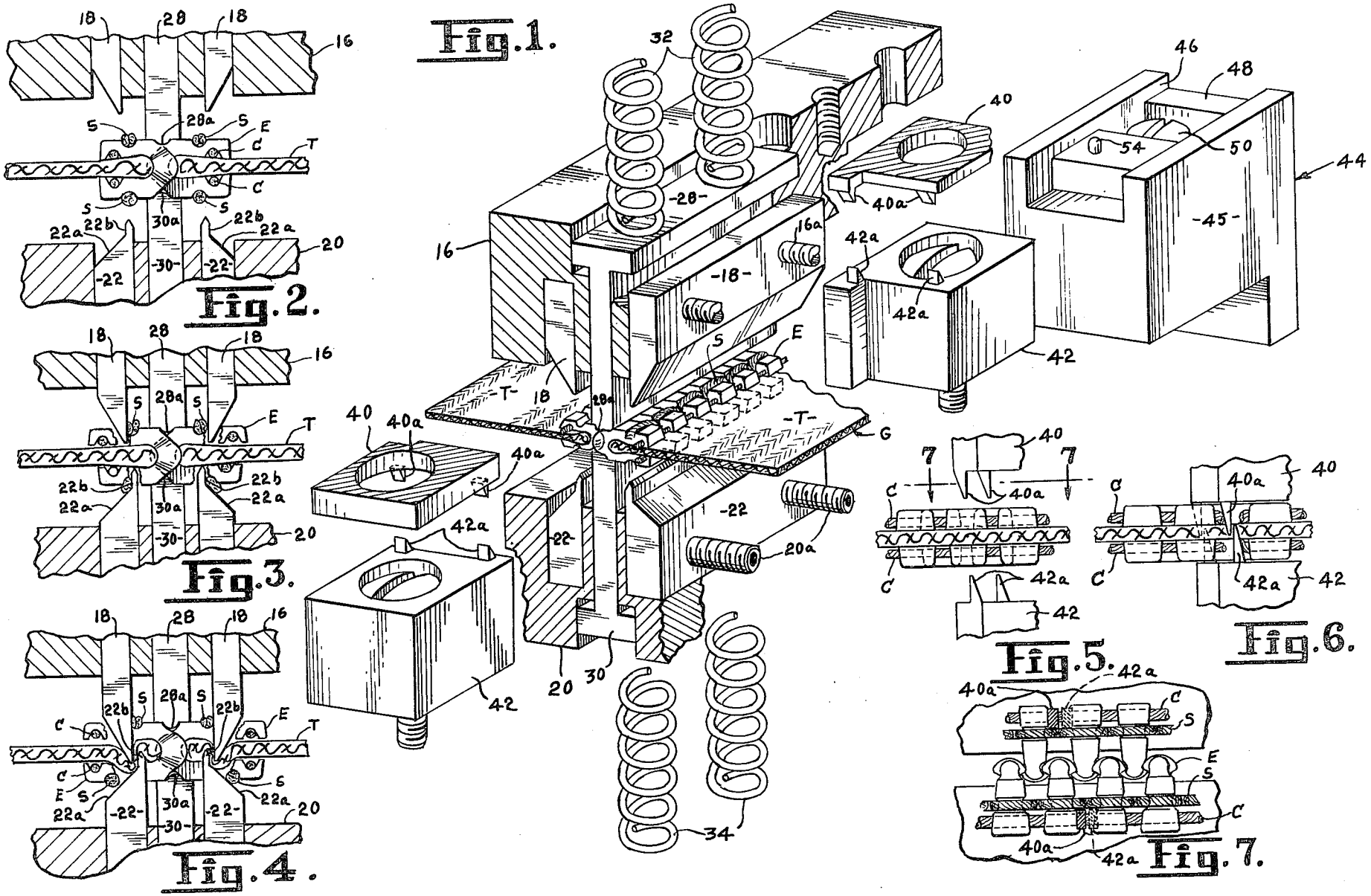
FIG. 1 is a fragmentary, partly sectional, partly exploded, perspective view of an apparatus embodying the invention.
FIGS. 2 through 4 are successive enlarged fragmentary sectional views showing the action of the knives on the fastener parts in the desired gap area.
FIGS. 5 and 6 are fragmentary successive views showing the cutting of the end cords at the ends of the desired gap area by means embodying the invention.
FIG. 7 is a sectional view taken on line 7—7 of FIG. 5.

Referring to FIGS. 2 through 4, it will be noted that the blade pairs 18, 22 work in generally but not absolutely vertically aligned sets. Particularly in FIGS. 3 and 4, it will be noted that the edges of the blades do not quite align. Due to the brittleness of the elements E and the relative flexibility of the tape, the closing of the pairs of blades 18 and 22 does effect the rupture of the legs of the U-shaped elements E, freeing them from the stitching S. The tape T, however (FIG. 4), folds in the area of the closed blades and is not sheared by the cooperating sets of blades 18, 22 with the result that the tape emerges from the opening blades unharmed, while each of the elements E in the desired gap area are sheared through.

It will be noted, particularly from FIGS. 1 and 4, that while the blades 18 have a straight bevel, the blades 22 have a bevelled portion **22*a* and a thin upright sharpened shank 22*b*. It is the cooperation of these shapes with the bevelled blades 18** which assures the rupturing and separating of the legs of the fastener elements E and the non-distortion of the tapes T.

Disposed at the opposite ends of the blades 18 and 22 are the upper cutting blocks 40 and 42, respectively. These blocks are bolted to the upper and lower plates 12 and 14, respectively (FIG. 8). The blocks 42 (FIG. 1) as well as the blocks 40 (sectionally shown in FIG. 1) are formed with projecting cutters **40*a* and 42*a*, respectively. The cutters on the upper and lower cutting blocks cooperate as shown in FIGS. 5, 6, and 7 to sever the cotton or nylon cords C which are molded into the fastener elements. The severing is accomplished adjacent the ends of the knives 18 and 20 to thereby liberate completely all portions of the fastener elements E disposed in the desired gap area. Thus, when the press is opened and the plates 12 and 14** separate, all fastener portions in the gap area may be removed leaving only the loose stitches S which have not been severed.

It will be noted from FIG. 5, for instance, that the sets of cutters 40*a* and 42*a* are slightly offset and not exactly opposite each other. The reason for this, of course, is that the zones inbetween the fastener elements E are staggered on one of the stringers in relation to the engaged stringer.

Indexing means 44 are provided (FIG. 1). This means comprises a block 45 secured to the bed plate 14 and having a channel recess 46 formed in its upper end to receive the lower portion of the fastener elements E (FIG. 8). Secured in the recess 46 is an index plate 48 fixedly movable longitudinally thereof by the bolt 50 which passes through a slot 52 in the plate.

An indexing pin 54 extends upward on the plate 48 and is adapted to engage between the lower set of adjacent fastener elements E as desired so as to position the desired gap area between the blades 18 and 22. Adjustment of the position of the pin 54 longitudinally of the chain G may be accomplished as desired by loosening bolt 50 from block 44 and moving the plate 48 as desired before retightening the bolt 50. Proper positioning of the pin 54, of course, assures the proper position of the chain G between the cutters 40*a* and 42*a*.

In operation, with the jaws of the press open and the plates 12 and 14 separated as shown in FIG. 2, the operator spreads the guides 28, 30 with a suitable tool and slips the line of elements E of the chain inbetween. The guide elements 28, 30 are then permitted to close so that their ribs 28*a* and 30*a* engage in the depression at the centerline of the engaged fasteners. The chain is then slipped along between the guides until it is properly positioned so that the knives 18, 22 align with the desired gap area. The press is then closed. As noted in successive FIGS. 2 through 4, the cooperating sets of knives 18, 22 approach each each other and close and rupture the legs of the respective elements E without distrubing the stitching S or injuring the tape T (FIG. 4). The parts of the elements in the gap area are thereby liberated from the stitches S.

Simultaneously, the cutters 40*a*, 42*a* close on the cords C severing them (FIG. 6) and actually penetrating the tape T. The press is then opened.

The resulting structure in the gap area leaves the liberated portions of the fastener elements free to be brushed away from the stitches S. Actually, the heel portions brush away singly while the end portions of the legs move away as four separate units, the portions in each unit being connected by the remnant of one of the severed cords C. As a consequence, after brushing, all that remains on the tape are the stitches S which appear somewhat loose, but maintain their integrity assuring the strength of the system.

An essential feature of the invention are the elongate guides 28, 30 which accurately position the fastener elements. These spring-pressed elongate guides serve to hold the elements E from the start to the finish of the gapping operation and are responsible for the correct positioning of the blades 18, 22 with respect to legs of the interposed elements.

Thus, the embodiments of the invention assure the neat and dependable severing of the elements in the desired gap area readying them for subsequent removal to establish a gap in the precisely desired area.

While the invention has been disclosed in but one form, it should be understood that it is not so limited but may be defined by the following claim language including equivalents:

I claim:

1. Apparatus for forming a desired gap in the lines of fastener elements in a slide fastener chain, the chain comprising a pair of stringers each having longitudinally aligned U-shaped plastic fastener elements held in longitudinally spaced relation by a pair of cords molded respectively into the ends of the legs of the U-shaped elements, the openings of the elements receiving respectively the edges of the slider tape, stitches securing the lines to the respective tapes, the elements of the two stringers being interengaged, the apparatus comprising (a) means to support the slide fastener in the area of the desired gap and hold it in proper lateral position with respect to the apparatus including a pair of aligned opposed spring-biased elongate guides disposed longitudinally of the lines and engaging the lines from opposite sides at approximately the zone of interengagement of the lines;

(b) a pair of vertically closing jaws adjacent the guides and carrying (1) a pair of sets of knives with one set on opposite sides of the guides respectively, the sets being cooperatively positioned and slightly laterally offset and adapted, as the jaws close, to break the legs of the fasteners in area of the desired gap of the respective lines at positions adjacent the stitches; and (2) four sets of cooperating cutters, each cutter set being disposed transversely of the lines of fasteners and adapted in the closing of the jaws to sever the cords at positions at the end of the desired gap;

whereby the portion of the lines of fastener elements in the desired gap after the reopening of the jaws may be removed to leave in the gap only the tapes and the residual stitches.

2. Apparatus as claimed in claim 1 wherein one of the jaws mounts means for holding the chain in proper longitudinal position with respect to the apparatus.

3. Apparatus as claimed in claim 1 wherein the spring-biased elongate guides are mounted in the respective jaws and disposed respectively inbetween and parallel to the cooperative pairs of longitudinal blades.

4. Apparatus as claimed in claim 1 wherein the sets of knives each include a bevel and a second knife having a thin flat extending portion slightly offset and out of alignment with the edge of the bevelled knife.

5. Apparatus for forming a desired gap in the lines of fastener elements in a slide fastener chain, the chain comprising a pair of stringers each having longitudinally aligned U-shaped plastic fastener elements held in longitudinally spaced relation by a pair of cords molded respectively into the ends of the legs of the U-shaped elements, the openings of the elements receiving respectively the edges of the slider tape, stitches securing the lines to the respective tapes, the elements of the two stringers being interengaged, the apparatus comprising (a) guide means for supporting the chain along its centerline;

(b) a pair of vertically closing jaws adjacent the guide means and carrying (1) a pair of sets of knives with one set on opposite sides of the guide means respectively, the sets being cooperatively positioned and slightly laterally offset and adapted, as the jaws close, to break the legs of the fasteners in area of the desired gap of the respective lines at positions adjacent the stitches; and (2) means to sever the cords at positions at the end of the desired gap;

whereby the portion of the lines of fastener elements in the desired gap after the reopening of the jaws may be removed to leave in the gap only the tapes and the residual stitches.

* * * * *